United States Patent [19]

Salansky

[11] Patent Number: 4,551,791

[45] Date of Patent: Nov. 5, 1985

[54] RECESSED LAMP

[75] Inventor: Werner Salansky, Vienna, Austria

[73] Assignee: Stabeg Apparatebaugesellschaft m.b.H., Vienna, Austria

[21] Appl. No.: 616,006

[22] Filed: May 31, 1984

[51] Int. Cl.[4] ..... F21V 7/18

[52] U.S. Cl. ..... 362/296; 362/310; 362/368; 362/350; 362/432; 362/365; 362/408

[58] Field of Search ..... 362/347, 368, 408, 296, 362/310, 350, 365, 432

[56] References Cited

U.S. PATENT DOCUMENTS 4,412,276 10/1983 Blinow ..... 362/307 X

FOREIGN PATENT DOCUMENTS 323961 8/1975 Austria .

*Primary Examiner*—Peter A. Nelson

*Attorney, Agent, or Firm*—Karl F. Ross; Herbert Dubno

[57] ABSTRACT

A lamp adapted to be mounted in a hole in a wall has an outer frame fittable in the hole, an inner housing part for securing the frame snugly in the hole bearing inward against the wall, a generally part-cylindrical reflector engageable snugly inside the frame, extending along an axis, and having one end extending axially past the opening and a socket for a bulb at the one end of the reflector. The reflector is of limitedly elastically flexible sheet metal, is of U-section, and at least one of its ends is axially open. A terminal box is provided on the inner housing part and a flexible electric wire extends between the box and the socket, passing out through the open end of the reflector. Both ends of the reflector extend axially past the opening and bear on the outer frame, and the reflector has axially extending edges provided with tabs engaging outwardly into the outer frame.

10 Claims, 6 Drawing Figures

RECESSED LAMP

FIELD OF THE INVENTION

The present invention relates to a lamp. More particularly this invention concerns a light fixture that is normally recessed in a wall or ceiling.

BACKGROUND OF THE INVENTION

A standard recessed lamp is a box-type reflector that is connected to a cable projecting out through a hole in a wall, and then fitted to the hole and secured in place. In order to ease installation and avoid hitting underlying structure it is standard to keep the entire fixture within the bounds defined by the hole, although some fixtures do have connection boxes that project laterally behind the installed fixture.

One such fixture, as described in Austrian Pat. No. 323,961, has a reflector pan or box provided at its ends with sockets for the bulbs. This structure therefore has the further disadvantage over the above-described system that the fully visible sockets are rarely attractive and reduce the effectiveness of the lamp by reducing the space available for bulbs.

Furthermore such devices often are quite difficult to install. Special clamps and clips must be manipulated with tools to secure a tight fit. Only the most complex and difficult-to-use systems can be used with a wide range of wall thicknesses.

OBJECTS OF THE INVENTION

It is therefore an object of the present invention to provide an improved recessed lamp.

Another object is the provision of such a recessed lamp which overcomes the above-given disadvantages, that is which is attractive, which reflects light efficiently, and which can be installed easily in walls of widely varying thicknesses without the use of hand tools.

SUMMARY OF THE INVENTION

A lamp adapted to be mounted in a hole in a wall according to the invention has an outer frame fittable in the hole, an inner housing part for securing the frame snugly in the hole bearing inward against the wall, a generally part-cylindrical reflector engageable snugly inside the frame, extending along an axis, and having one end extending axially past the opening and a socket for a bulb at the one end of the reflector.

According to this invention the reflector is of limitedly elastically flexible sheet metal and is of U-section, and at least one of its ends is axially open. This construction is extremely simple. A terminal box is provided on the inner housing part and a flexible electric wire extends between the box and the socket, passing out through the open end of the reflector. As a result the problems of constructing the prior-art closed-sided reflector are avoided, making fabrication as simple and inexpensive as impossible. A further feature that makes construction simple and inexpensive is leaving the reflector axially open at both ends.

Both ends of the reflector extend axially past the opening and bear on the outer frame, and the reflector has axially extending edges provided with tabs engaging outwardly into the outer frame. This construction also makes it possible to form the reflector so that, when not installed, the distance between its sides is greater than the distance between the frame sides the tabs fit between. The result is leaf-spring action which holds the fixture snugly in the frame.

The inner housing part that secures the outer frame according to this invention bears bearing outward, that is opposite the direction the outer frame bears on the wall, against the wall around the hole. This inner housing part is resiliently attached to the outer frame, typically by at least one flexible strap fixed to the outer frame. In a simple embodiment the inner housing part is a flexibly deformable U-shaped element secured to the strap and bearing outward against the wall. It can also have a plurality of legs bearing outward against the wall.

Such an arrangement can fit the lamp to a very thick or thin wall when provided with tension springs engaged between the inner housing part and the outer frame part, these springs having outer ends hooked directly into the outer frame part and inner ends. Pivotal tensioning elements on the inner housing part have outer ends connected to the inner spring ends and are displaceable between open positions with their outer ends relatively close to the outer frame part and closed positions with their outer ends relatively far therefrom. Thus movement from the open to the closed positions tensions the springs and grips the wall tightly between the outer frame and inner housing part.

The inner housing part of this invention has means for latching the tensioning elements in the closed positions, such means including a notch formed in the inner housing part. The tensioning element has a projecting arm engageable with the inner housing part and through the notch and is also displaceable along its pivot axis between a center position with the arm engageable with the inner housing part and preventing pivoting of the element and a laterally offset position with the arm engageable through the notch and movable freely between the closed and open positions. The springs are more tensioned in the offset position than in the center position so that they are naturally returned to the center position. It is therefore possible to axially shift the elements, then pivot them to the closed position to tension the springs and lock the housing formed by the frame and inner housing part to the wall. The element is pivoted through the notch, then slid back so it bears against it. Thus it is possible to mount the lamp in a hole without tools once the connection is made, which itself can be a simple plug-in.

DESCRIPTION OF THE DRAWING

The above and other features and advantages will become more readily apparent from the following, it being understood that any feature described with reference to only one embodiment of the invention can be used where possible with any other embodiment. In the accompanying drawing.

SPECIFIC DESCRIPTION

Figure 1:
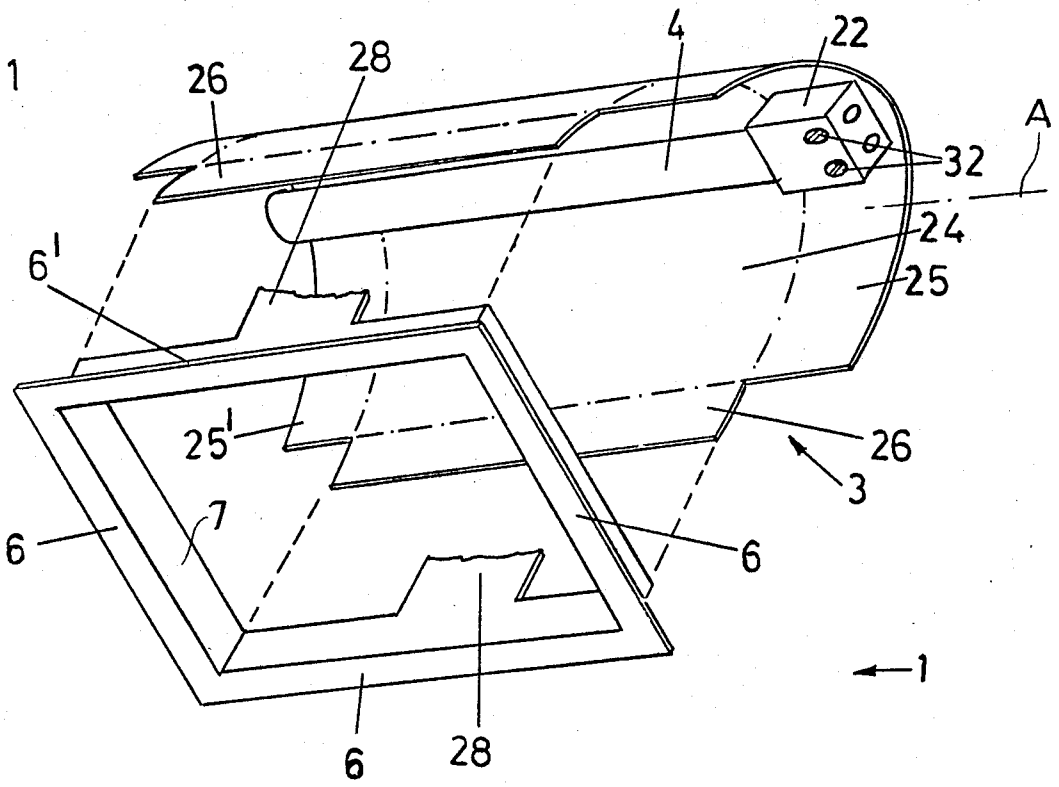
FIG. 1 is an exploded view of a lamp according to the present invention.
Figure 2:
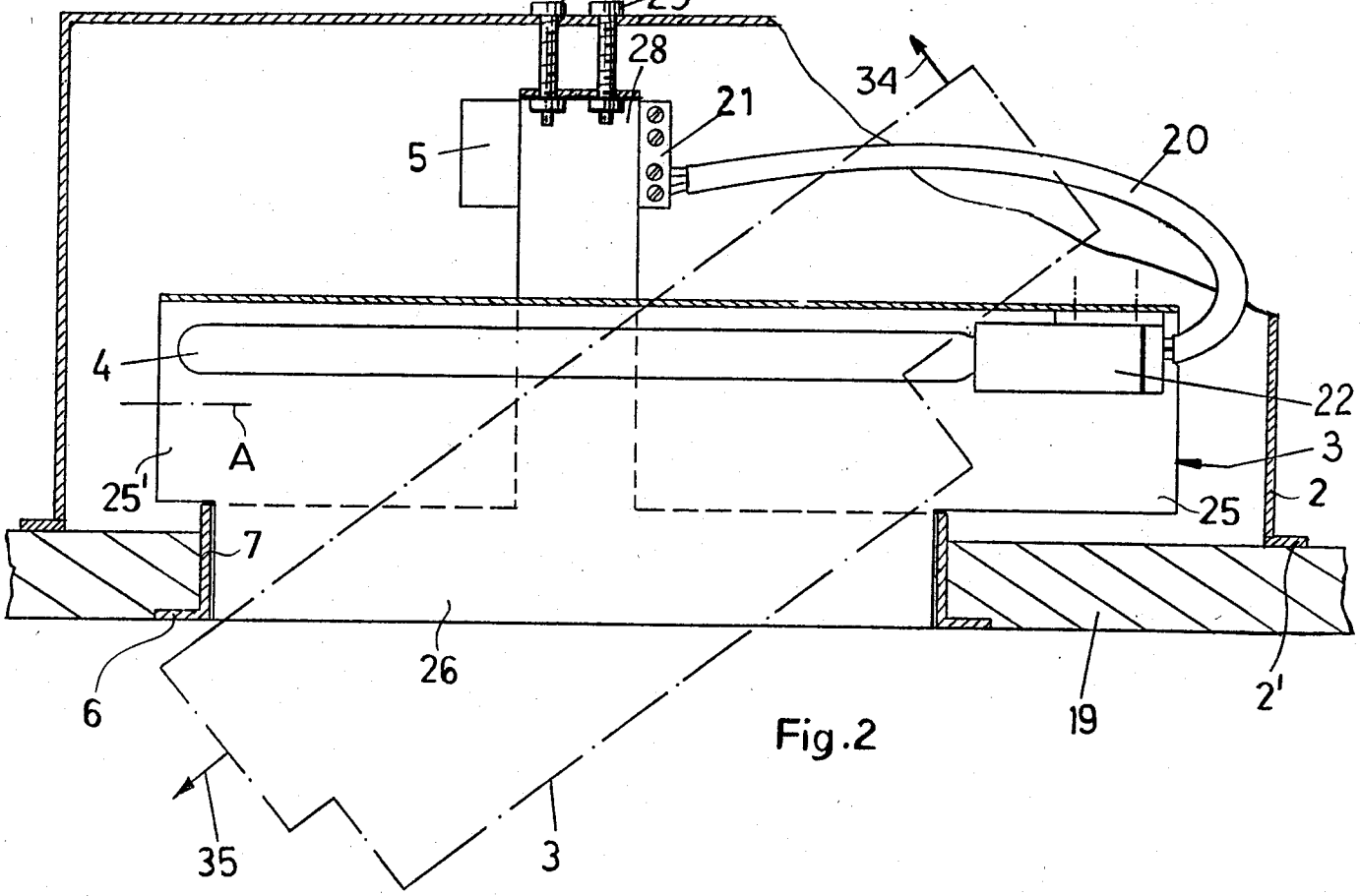
FIG. 2 is an axial section through the lamp of FIG. 1 installed in a ceiling.

As seen in FIGS. 1 and 2 a lamp according to this invention basically is comprised of an outer housing part 1, an inner housing part 2, and a reflector 3. The lamp 1, 2, 3 is designed to be mounted in a rectangular hole cut in a wall 19, here a ceiling.

The outer housing part 1 is an L-section annular frame having a planar flange 6 adapted to lie against the lower or outer surface of the wall 19 and an annular rim 7 that extends up inside this wall opening. In fact the hole in the wall can be fairly rough, so long as the outer flange 6 can cover up any irregularities. A loop or strap 28 extends between the middles of inner rim 7 at the two opposite long sides of the frame 1.

The inner housing part 2 is constituted as a generally U- or omega-shaped clip whose feet 2' lie against the inside of the wall 19 and whose middle is secured by bolts 29 to the middle of the loop or strap 28. These two parts 1 and 2 are made of strong but elastically deformable material, for instance sheet brass. Thus it is possible for the clip 2 to flex quite a bit to accommodate the lamp to walls of different thicknesses.

The reflector 3 is basically U-section, semicylindrical centered on an axis A, with a pair of end tabs 25 and 25' and a pair of side tabs 26. The tab 25 is somewhat longer than the tab 25' and carries at its center a socket 22 for a bulb 4. A wire 20 extends from this socket 22 to a terminal block 21 on a connector box 5 of the lamp. The length of the tabs 26 is slightly less than that of the long sides of the frame 6 and the width of these tabs 26 is the same as the height of the rim 7. Thus the reflector can be snapped in place with the two tabs 26 bearing resiliently against the inner faces of the long sides of the frames and the end tabs or extensions 25 and 25' extending across and lying on the short sides of the rectangular frame 6. When in this position the socket 22 is hidden behind the wall 19.

This lamp can be mounted in place by placing the clip 2 through the hole so it stands in the illustrated position. Then the frame 1 is fitted to the hole 1 and the clip 2 is deformed somewhat as the screws or bolts 29 are emplaced and tightened. The reflector 3, which can meanwhile be dangling by its wire 20, is then fitted up through the hole, tab 25 first, until it can be swung down and seated as illustrated in solid lines in FIG. 2.

The reflector 3 can be removed for servicing or cleaning simply by pushing its rear up as indicated by arrow 34 and the dot-dash lines of FIG. 2, and then pulling down as indicated by arrow 35. This operation is extremely easy.

Figure 3:
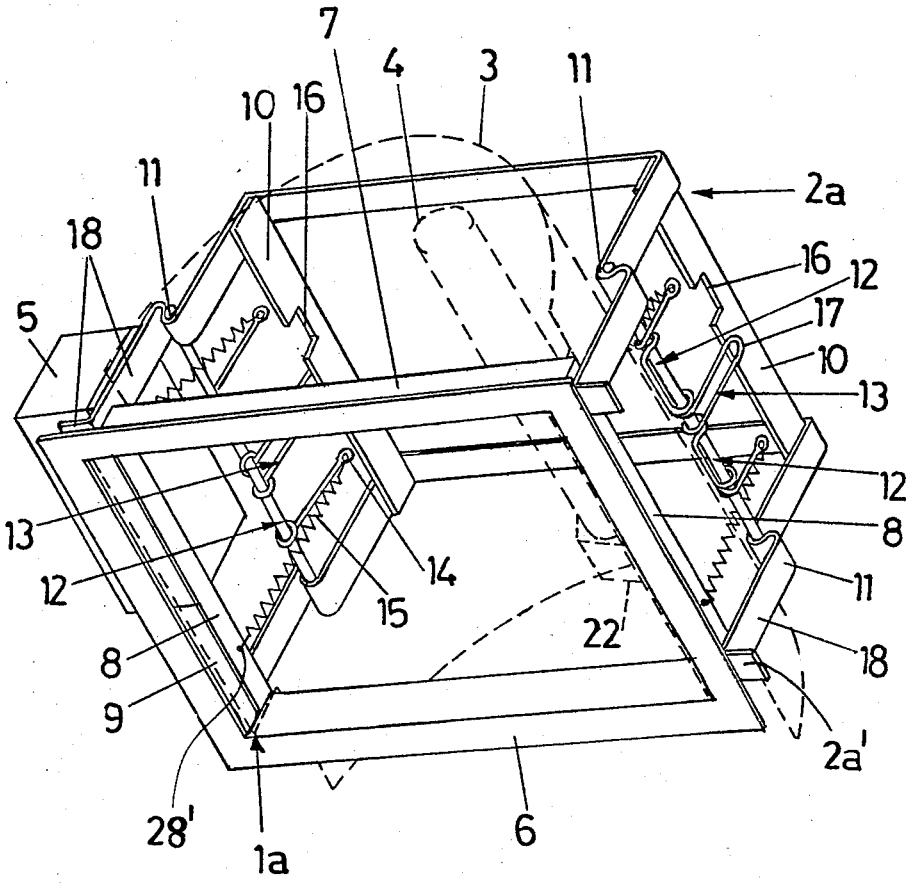
FIG. 3 is a perspective view of another housing assembly for a lamp according to this invention.
Figure 4:
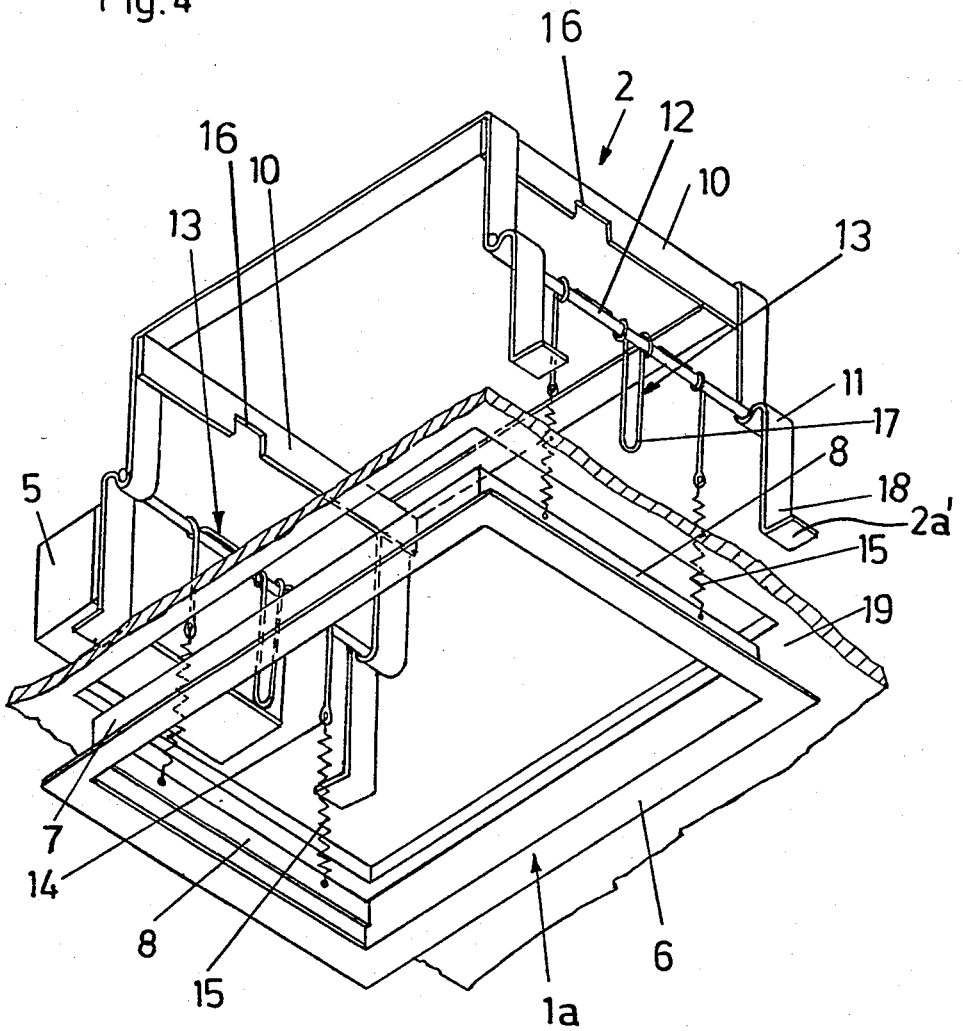
FIG. 4 is an exploded view of the housing of FIG. 3.
Figure 5A:
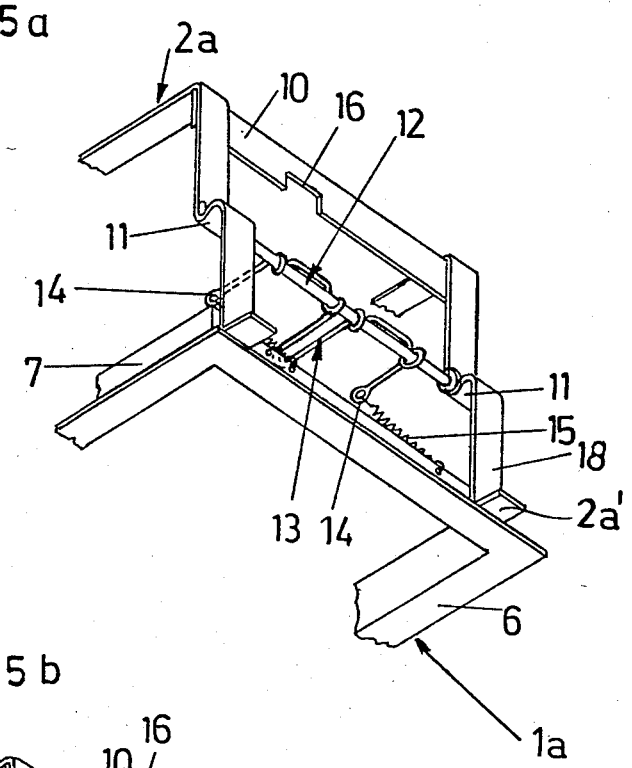
FIGS. 5*a* and 5*b* are perspective views of details of the housing of FIG. 3 in the open or loose position and the closed or tight position, respectively.
Figure 5B:
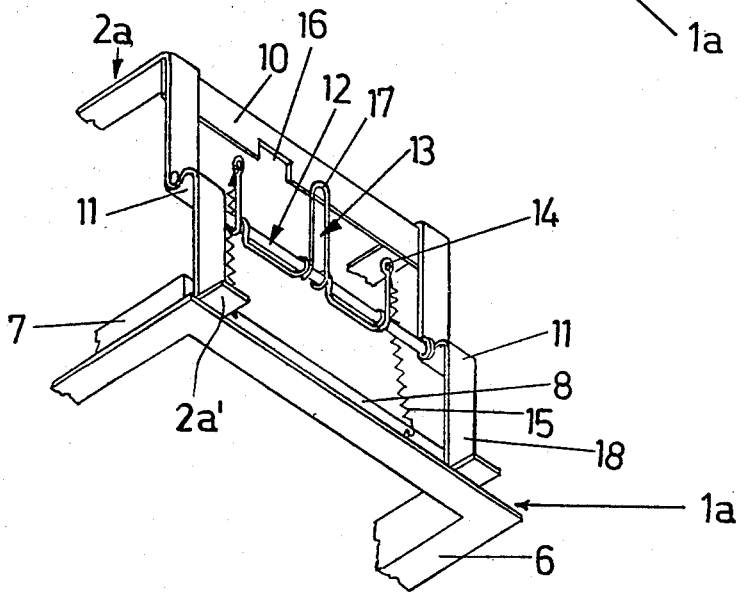

The arrangement of FIGS. 3, 4, and 5 uses an identical reflector assembly 3. The outer frame **1*a* is the same as that of FIGS. 1 and 2, except that it is missing the loop 28, and has two opposite inner transverse flanges 8 spaced by a gap 9 from the respective face flange 6 and each formed with two holes 28'**.

Here the inner housing part **2*a* is formed as two omega-shaped clips and has four legs 18 connected together by a rectangular frame 10 and having at their inner ends feet 2*a'* that bear against the inside of the wall 19. These legs 18 are each formed with an inwardly U-shaped seat region 11, and two parallel axle rods 12 are seated in these regions 11 and each carry a W-shaped tightening element 13. Four highly stretchable tension springs 15 each have one end hooked in the respective hole 28' and an opposite end hooked in the outer end of the respective one of the two outer legs 14 of the one element 13, which has a central actuating tab or loop 17 coplanar with the legs 14. The elements 13 can slide along the respective rods 12 from the illustrated central positions to positions in which the central actuating tabs 17 can swing through notches 16** cut in the frame.

Such a lamp is installed by first positioning the inner housing part **2*a* on the far side of the wall 19, then hooking its springs 15 in the holes 28' and positioning the frame 1*a*. Then each of the actuating elements 13 is slid toward the notch 16 and then pivoted around so the part 17 can pass through this notch. The elements 13 are then slid back to lock the part 17 against the frame. This leaves the springs 15 tightly tensioned and the two housing parts 1*a* and 2*a* tightly gripping the wall 19. When the gap 9 is wider than the thickness of the wall 19, it is possible to engage the feet 2*a'* inside the frame 1*a* through the gap 9**, thereby making the assembly very secure in spite of its ease of assembly.

Then the reflector 3 is installed in the manner described with respect to FIGS. 1 and 2. The connector box 5 is mounted on the inner housing part **2*a*, so the springs 15 need not carry its weight, only that of the outer housing part 1*a* and the reflector 3**.

I claim:

1. A lamp adapted to be mounted in a hole in a wall, the lamp comprising:

an outer frame fittable in the hole;

means for securing the frame snugly in the hole bearing inward against the wall;

a generally part-cylindrical reflector engaged snugly inside the frame, extending along an axis, and having a pair of axially open ends bearing outward against the outer frame and extending axially past the opening, the reflector being of limitedly elastically flexible sheet metal and of U-section and having axially extending edges provided with tabs engaging outward into the outer frame;

a socket for a bulb at one of the ends of the reflector and wholly hidden by the frame;

a terminal box on the securing means; and a flexible electric wire extending between the box and the socket.

2. The lamp defined in claim 1 wherein the securing means includes:

an inner housing part bearing outward against the wall around the hole; and means attaching the inner housing part resiliently to the outer frame.

3. The lamp defined in claim 2 wherein the attaching means includes a flexible strap fixed to the outer frame and fasteners connected between the inner housing part and the flexible strap.

4. The lamp defined in claim 3 wherein the inner housing part is a flexibly deformable U-shaped element secured by the fasteners to the strap and bearing outward against the wall.

5. The lamp defined in claim 2 wherein the inner housing part has a plurality of legs bearing outward against the wall.

6. The lamp defined in claim 2 wherein the attaching means includes tension springs engaged between the inner housing part and the outer frame part.

7. The lamp defined in claim 6 wherein the springs have outer ends hooked directly into the outer frame part and inner ends, the attaching means including pivotal tensioning elements on the inner housing part and having outer ends connected to the inner spring ends.

8. The lamp defined in claim 7 wherein the tensioning element are displaceable between open positions with their outer ends relatively close to the outer frame part and closed positions with their outer ends relatively far therefrom, whereby movement from the open to the closed positions tensions the springs.

9. The lamp defined in claim 8 wherein the inner housing part is provided with means for latching the tensioning elements in the closed positions.

10. The lamp defined in claim 9 wherein the latching means includes a notch formed in the inner housing part, the tensioning element having a projecting arm engageable with the inner housing part and through the notch, the tensioning element further being pivotal about and displaceable along an axis between a center position with the arm engageable with the inner housing part and preventing pivoting of the element and a laterally offset position with the arm engageable through the notch and movable freely between the closed and open positions, the respective springs being more tensioned in the offset position than in the center position.

* * * * *